US005906868A

United States Patent [19]

Akin

[11] Patent Number: 5,906,868

[45] Date of Patent: May 25, 1999

[54] ARTICLE OF MANUFACTURE FORMED OF COPPER FITTINGS

[76] Inventor: William S. Akin, 3745 Starboard La., Lithonia, Ga. 30058

[21] Appl. No.: 08/902,086

[22] Filed: Jul. 29, 1997

[51] Int. Cl.[6] ..... A47G 33/00

[52] U.S. Cl. ..... 428/3; 428/14; 431/295

[58] Field of Search ..... 428/3, 7, 18, 14; 431/295

[56] References Cited

U.S. PATENT DOCUMENTS

D. 341,621 11/1993 Evenson ..... D19/34.1

D. 362,017 9/1995 McConnell ..... D19/34.3

4,389,813 6/1983 Jaques et al. ..... 428/18 X 5,630,291 5/1997 Fontana ..... 428/23 X

*Primary Examiner*—Henry F. Epstein

*Attorney, Agent, or Firm*—William B. Noll

[57] ABSTRACT

The invention relates to articles of manufacture formed of a variety of copper fittings, such as 90 degree-elbows, tees, nipples, and straight pipe sections. The articles essentially comprise a pair of components formed of multiple copper fittings, where such components are pivotally mounted to one another. Finished articles may include, for example, a free standing picture frame or a candelabra.

8 Claims, 1 Drawing Sheet

ARTICLE OF MANUFACTURE FORMED OF COPPER FITTINGS

FIELD OF THE INVENTION

This invention is directed to the field of household products, such as a picture frame, or candelabra, that may be formed from a variety of copper fitting, including but not limited to 90 degree-elbows, tees, threaded couplings, nipples and straight pipe sections.

BACKGROUND OF THE INVENTION

The invention relates to a creative line of homefurnishings that may be fabricated from ordinary copper plumbing fittings, then appropriately cleaned and dressed to reflect a unique style of inexpensive household products.

Typically, the types of household products, to which this invention is directed, are molded of plastic, fabricated of metal strips, or machined from metal rods. All such procedures are expensive and yield products that are ordinary at best.

By way of example, U.S. Pat. No. D-341,621 relates to a bookend formed from a planar sheet of metal that has a U-shaped cutout in the center, than bent at a 90 degree angle with the arcuate configured book support perpendicular to the cutout. U.S. Pat. No. D-362,017 represents another example of a household product fabricated from common metal products. Such product is a set of bookends fabricated from a short section of an L-shaped angle iron having an actual or simulated threaded bold and nut extending from the face of one bookend, and an actual or simulated washer and bolt head extending from the face of the other bookend. When supporting a set of books, the product has the appearance of a bolt extending from one bookend, through the books, then terminating at the opposite bookend.

These prior art products, though useful, may be expensive and even ordinary. The present invention is unique in its construction, as it utilizes common copper plumbing fittings to form the primary components. The manner by which this construction achieves the desired result can best be explained by the following specification, particularly when read in conjunction with the accompanying drawings.

SUMMARY OF THE INVENTION

Invention relates to a free standing article of manufacture, such as a picture frame or candelabra, by way of example, formed of a plurality of copper conduit products. Such products may be selected from the class of 90 degree-elbows, tees, threaded couplings, nipples and straight pipe sections. Each article consists of a first component comprising a continuous member formed by four 90 degree-elbows joined by straight pipe sections or nipples into a rectangular shape, and a second component, also formed of copper fittings, joined thereto. The two components, when assembled, are movable relative to one another so as to change the spatial relationship of the article of manufacture.

BRIEF DESCRIPTION OF THE DRAWINGS

FIG. 3 is a perspective view of the base for the household product of FIG. 2.

DETAILED DESCRIPTION OF PREFERRED EMBODIMENT

This invention relates to a creative line of household products formed from a variety of copper plumbing fittings, where only the imagination will limit the type and number of products to be designed. The several Figures illustrate two unique examples of household products that can be formed of common copper fittings, such as 90 degree-elbows, tees, threaded couplings, nipples and straight pipe sections.

Figure 1:
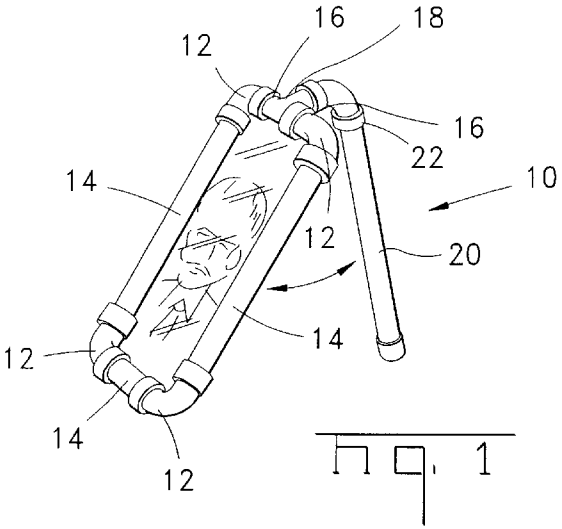
FIG. 1 is a perspective view of a household product, i.e. picture frame, formed of copper plumbing fittings in accordance with the invention.
Figure 7:
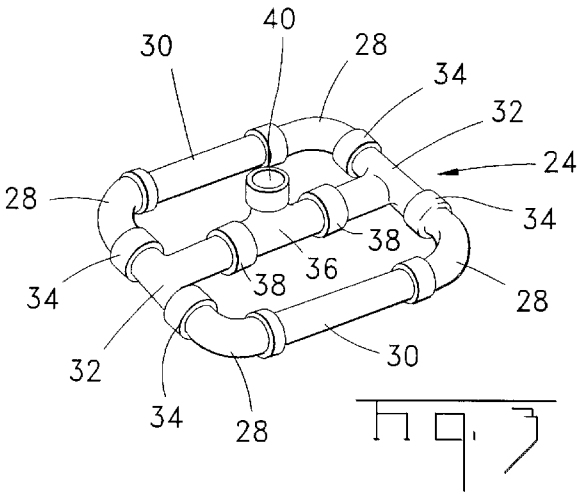

FIG. 1 is the first of such examples in the form of a picture frame 10. The picture frame 10 consists of four 90 degree-elbows 12 joined to form a rectangular shape by straight pipe sections 14 on three sides, and a pair of nipples 16 and pivotal tee 18 along the fourth side. The tee 18 may be a standard tee or a right angle tee. In either case, a straight pipe section 20 is fixed to the free leg 22 of the tee 18 and functions as a support for the free standing picture frame 10. By the pivotal nature of the tee 18, one can position the picture frame as desired. Except for the pivoting tee, all remaining joints are soldered or welded.

In order to present the household product in its best appearance, and this applies to all finished products, it may then be cleaned and dressed to present a unique and stylish product. For instance, the product may be given a clear spray coat of lacquer, sanded for smoothness, then given a finishing coat for protection against oxidation or aging, as desired. Finally, some suitable picture receiving means, not illustrated, may be applied to the back of the frame 10 for receiving the picture to be displayed.

Figure 2:
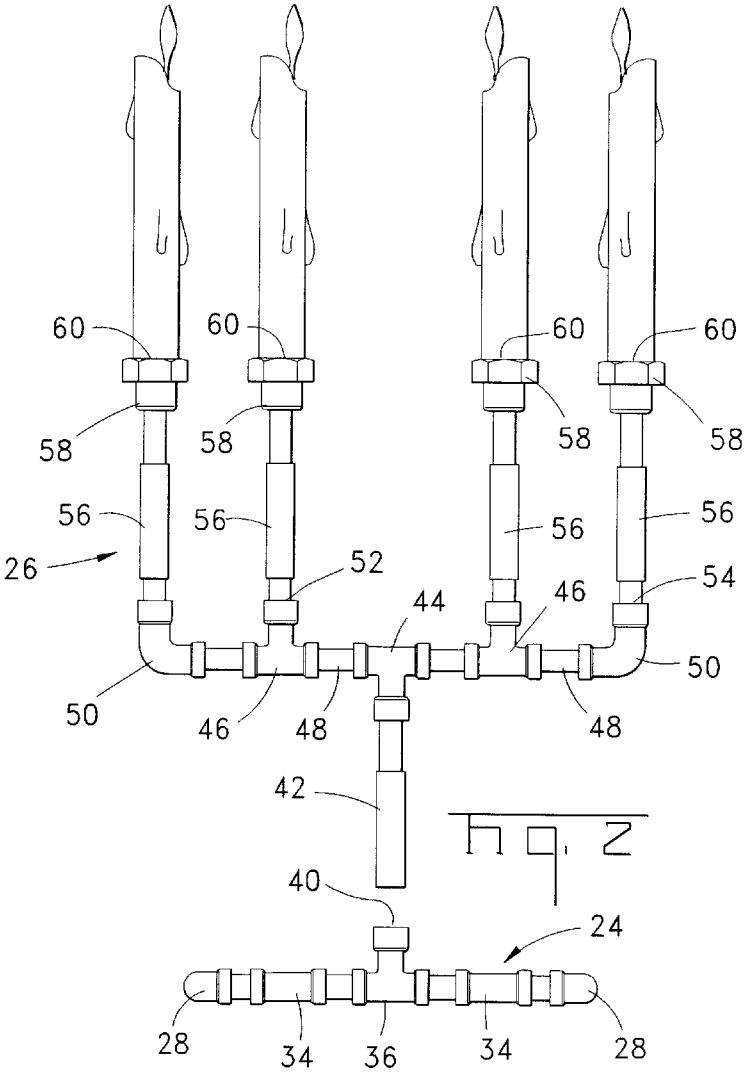
FIG. 2 is a plan view of an assembled second household product, i.e. candelabra, formed of copper plumbing fittings in accordance with the invention.

FIG. 3 illustrates one component, a base 24, for the candelabra 26 of FIG. 2. The base 24 comprises a rectangular shape formed by four 90 degree-elbows 28, straight pipe sections 30 along opposing sides, with the two remaining sides consisting of a pair of inwardly directed tees 32 and nipples 34. The inwardly directed tees 32, in turn, are joined by a bisecting member consisting of a third, upwardly directed tee 36 and nipples 38. As best seen in FIG. 2, the open end 40 of tee 36 is positioned to receive the leg 42 of the candelabra 26.

The candelabra 26, like the other household products, are formed of copper plumbing fittings. The candelabra 26 includes a tee 44, for pivotally mounting to leg 42, and a pair of extensions formed by one or more tees 46, joining nipples 48, and at the ends a 90 degree-elbow 50. Note that in this arrangement the open ends 52, 54 of the tees 46 and elbows 50, respectfully, are directed upward. To such open ends 52, 54, nipples 56 are added, then topped off with threaded couplers 58. As shown in phantom, candles may be inserted into the open ends 60 of the threaded couplers 58.

In each of the examples depicted in the several Figures, there are essentially tow primary components that are movable relative to one another, so that one can readily change the spatial relationship of the article of manufacture.

I claim:

1. A free standing article of manufacture formed of a plurality of copper conduit products, consisting of 90 degree-elbows, tees, threaded couplers, nipples and straight pipe sections, each said article consisting of a first component comprising a continuous member formed by four 90 degree-elbows joined by straight pipe sections or nipples to form a rectangular shape, and a second component joined thereto and formed of said copper fittings, where said second component is movable relative to said first component to change the spatial relationship of said article of manufacture.

2. The free standing article of manufacture according to claim 1, wherein said second component includes a straight pipe section fixedly secured to a tee, where said tee is pivotally mounted to said first component along a plane perpendicular to the plane of said first component.

3. A free standing article of manufacture according to claim 1, wherein said article is a picture frame.

4. The free standing article of manufacture according to claim 1, wherein said second component is pivotally mounted for movement in a plane parallel to the plane of said first component.

5. The free standing article of manufacture according to claim 1, wherein said first component includes a bisecting member arranged in the plane of said first component, said bisecting member including a centered tee for mounting said second component perpendicular thereto.

6. The free standing article of manufacture according to claim 5, wherein said second component is pivotally mounted to a first pipe section, which in turn is fixedly mounted to said centered tee.

7. The free standing article of manufacture according to claim 5, wherein said second component includes a first tee pivotally mounted to said first pipe section, and that said first tee includes a pair of laterally aligned extensions.

8. The free standing article of manufacture according to claim 7, wherein said article is a candelabra.

* * * * *